US005083885A

United States Patent [19]

Ushitora et al.

[11] Patent Number: 5,083,885

[45] Date of Patent: Jan. 28, 1992

[54] LAYING STRUCTURE FOR VACUUM SEWER PIPE OF VACUUM SEWAGE COLLECTING SYSTEM

[75] Inventors: Akihiro Ushitora, Kanagawa; Kazuo Yamaguchi; Toshiyuki Hasegawa, both of Tokyo; Tsuneo Asanagi, Kanagawa, all of Japan

[73] Assignee: Ebara Corporation, Tokyo, Japan

[21] Appl. No.: 661,684

[22] Filed: Feb. 27, 1991

[30] Foreign Application Priority Data

Feb. 28, 1990 [JP] Japan ..... 2-50581

[51] Int. Cl.[5] ..... E03F 1/00

[52] U.S. Cl. ..... 405/36; 137/236.1; 210/170; 405/80

[58] Field of Search ..... 405/36, 52, 80; 137/236.1; 210/170, 532.1, 532.2, 747

[56] References Cited

U.S. PATENT DOCUMENTS 3,730,884 5/1973 Burns et al. ..... 137/236.1 X
4,155,851 5/1979 Michael ..... 210/170 X
4,171,853 10/1979 Cleaver et al. .
4,179,371 12/1979 Foreman et al. ..... 210/170 X
4,333,830 6/1982 Michael ..... 210/170
4,373,838 2/1983 Foreman et al. .
4,892,440 1/1990 Regan ..... 405/36

*Primary Examiner*—David H. Corbin
*Attorney, Agent, or Firm*—Jones, Day, Reavis & Pogue

[57] ABSTRACT

A laying structure for a vacuum sewer pipe of a vacuum sewage collecting system for collecting sewage discharged from homes and facilities into a collecting tank through a vacuum sewer pipe kept negative in pressure internally is disclosed. The vacuum sewer pipe includes a portion laid in a plain topography which comprises a downward pitch portion sloped toward downstream, and a short upward pitch portion connected to the downstream end of the downward pitch portion to return a depth of the vacuum sewer pipe to an original level, the downward pitch portion and the upward pitch portion are alternated at least once. The upward pitch portion starts from a spot deepened from the original laying level by a depth corresponding to 0.8 to 1.0 times of a bore of the vacuum sewer pipe. By this arrangement, an air lock is not produced at the upward pitch portion even if the quantity of air flowing in the vacuum sewer pipe is low.

5 Claims, 3 Drawing Sheets

LAYING STRUCTURE FOR VACUUM SEWER PIPE OF VACUUM SEWAGE COLLECTING SYSTEM

BACKGROUND OF THE INVENTION

1. Field of the Invention

This invention relates to a laying structure for a vacuum sewer pipe of a vacuum sewage collecting system for collecting sewage discharged from homes and facilities.

2. Prior Art

A vacuum sewage collecting system is widely used to collect sewage discharged from homes and facilities.

FIG. 3 is a view representing a general construction of a vacuum sewage collecting system of this kind.

As illustrated therein, sewage discharged from each home 30 flows into a cesspool 32 located underground by way of an underground sewer pipe 31 under the influence of gravity. When the sewage accumulates at a lower portion of the cesspool 32 in a predetermined quantity, a vacuum valve 33 mounted on an upper portion of the cesspool 32 opens, and the sewage in the cesspool 32 is sucked in from a suction pipe 34.

The sewage is then sucked into a vacuum sewer pipe 1 laid like network in the ground by way of the vacuum valve 33 and collected in a sewage tank 41 in a vacuum pump house 40.

The sewage accumulated in the sewage tank 41 is then sent to a sewage treatment plant and so forth by a pressure feed pump 42. To maintain both the sewage tank 41 and the vacuum sewer pipe 1 at an internal negative pressure, a vacuum pump 43 is connected to the sewage tank 41.

FIG. 4 is a side sectional view representing a state wherein the vacuum sewer pipe 1 is buried in the ground in a plain topography.

As illustrated therein, the vacuum sewer pipe 1 is usally laid so that it includes a downward pitch portion 11 having a slope of 0.2 to 0.3% with reference to the horizontal plane toward the downstream side (that is, on the sewage tank 41 side in the vacuum pump house 40), and when it is deepened by a predetermined depth from an original or first laying level by the downward pitch portion 11, a short upward pitch portion 12 is provide so as to return the laying depth of the pipe to the original laying level.

In such a system, as shown in FIG. 5, even if the sewage having flowed on the downward pitch portion 11 as being drawn by the air accumulates at the deepest portion, since the air and the sewage are successively advanced into the deepest portion, the sewage accumulated in this portion is blown up by the air to exceed the upward pitch portion 12, and thus flows further ahead.

Meanwhile, a depth of the connecting portion between the upward pitch portion 12 and the downward pitch portion 11 was selected hitherto at a position considerably deeper than the depth corresponding to a bore of the vacuum sewer pipe 1 from the original or shallowest laying level of the vacuum sewer pipe 1.

That is, for example, a height of the upward pitch portion 12 was selected at 200 mm or 300 mm in the case of vacuum sewer pipe 1 100 mm in bore.

However, such a pipe laying structure caused the following problems.

(1) Where the quantity of air flowing in the vacuum sewer pipe 1 is low, an air lock may be formed at a portion of the upward pitch portion 12 as shown in FIG. 6, thus a degree of vacuum on the upstream side is abated according as it goes toward the end of a line of the vacuum sewer pipe 1.

(2) If the vacuum sewer pipe 1 is laid with the downward slope of 0.2 to 0.3% in plain ground, a laying depth gradually increases. However, in the aforementioned prior art system, since the laying depth is returned to the original laying depth by providing an upward pitch portion at a spot considerably deeper than a level of the minimum laying depth required for roads, the laying depth greater than necessary on the whole, thus leading to an increase in construction costs.

SUMMARY OF THE INVENTION

This invention has been carried out in view of the aforementioned problems, and its object is to provide a laying structure for a vacuum sewer pipe of a vacuum sewage collecting system, which enables formation of an air lock in the vacuum sewer pipe to be avoided and to make the laying depth of the vacuum sewer pipe 1 as small as possible.

To accomplish the aforementioned objects, this invention provides a pipe laying structure wherein a vacuum sewer pipe includes a portion laid in a plain topography which comprises a downward pitch portion sloped toward downstream, and a short upward pitch portion connected to the downstream end of the downward pitch portion to return a laying depth of the vacuum sewer pipe to an original laying level. The downward pitch portion and the upward pitch portion are alternated at least one time. The upward pitch portion starts from a spot deepened from the original laying level by a depth corresponding to 0.8 to 1.0 times of a bore of the vacuum sewer pipe.

By this arrangement, since a height of the upward pitch portion of the vacuum sewer pipe is kept the same as or smaller than a bore of the vacuum sewer pipe, even in the case that the quantity of air flowing in the vacuum sewer pipe is low, an air lock will not be produced at a portion of the upward pitch portion. And, therefore, a negative pressure produced in a vacuum pump house can be fed as far as the end of a line of the vacuum sewer pipe.

Also, since the height of the upward pitch portion is smaller as compared with a prior art system, a laying depth of the vacuum sewer pipe may be made shallower.

The above and other objects, features and advantages of the present invention will become more apparent from the following description when taken in conjunction with the accompanying drawings in which a preferred embodiment of the present invention is shown by way of illustrative examples.

DETAILED DESCRIPTION OF THE PREFERRED EMBODIMENTS

One preferred embodiment of this invention will now be described in detail with reference to the accompanying drawings.

Figure 1:
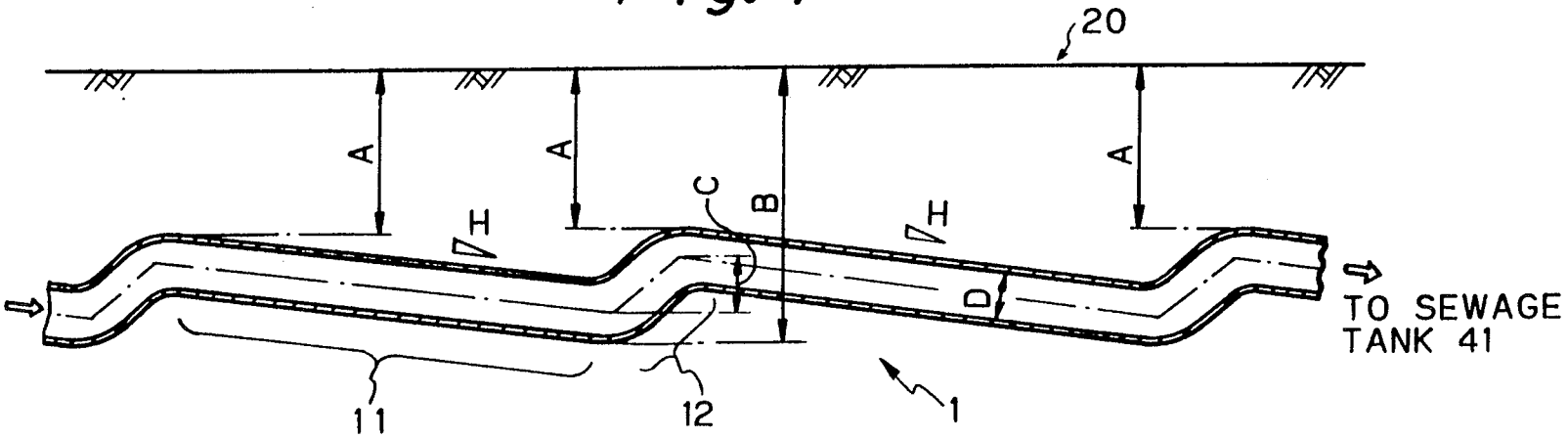
FIG. 1 is a side sectional view representing a state where the vacuum sewer pipe 1 is laid in a plain topography in accordance with the invention.

FIG. 1 is a side sectional view representing a state wherein a vacuum sewer pipe 1 is laid in a plain topography in accordance with the invention.

As illustrated therein, the vacuum sewer pipe 1 comprises a downward pitch portion 11 and an upward pitch portion 12 laid under a plain ground 20.

Here the vacuum sewer pipe 1 is laid so that the original or shallowest portion will be positioned at a minimum laying depth A which is determined on the basis of the standard required for roads and other conditions.

The downward pitch portion 11 is laid with a downward slope of 0.2 to 0.3% with reference to a horizontal plane toward downstream (slope of downward pitch portion 11 being indicated fairly larger than 0.2 to 0.3% for the convenience of illustration in the drawing).

When the vacuum sewer pipe 1 is deepened by a depth C, which corresponds to 0.8 to 1.0 times of a bore of the vacuum sewer pipe 1, an upward pitch portion 12 is provided to shallow it by the depth C.

Figure 3:
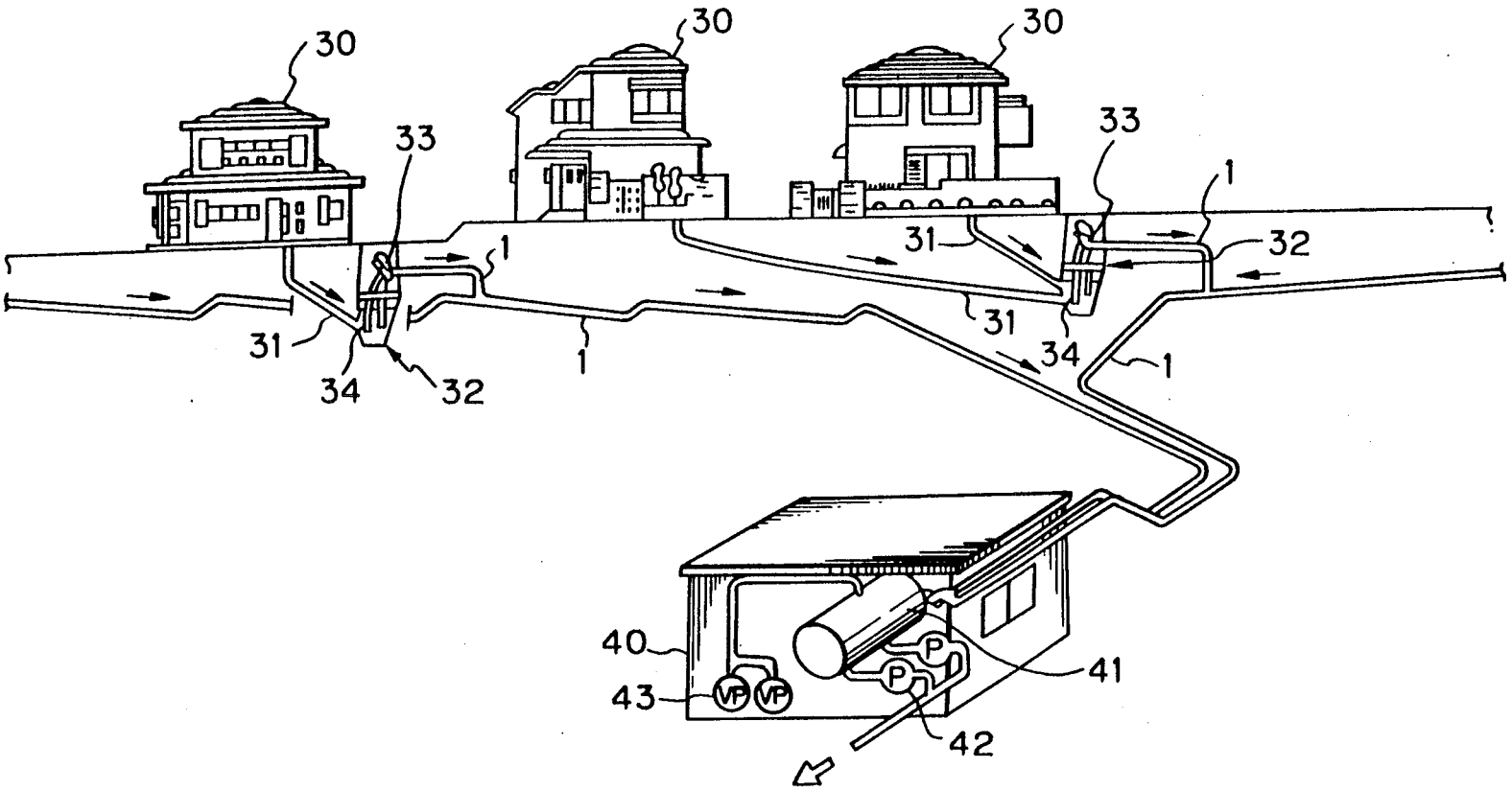
Fig. 3 PRIOR ART
FIG. 3 is an illustration representing a general construction of a conventional vacuum sewage collecting system.
Figure 4:
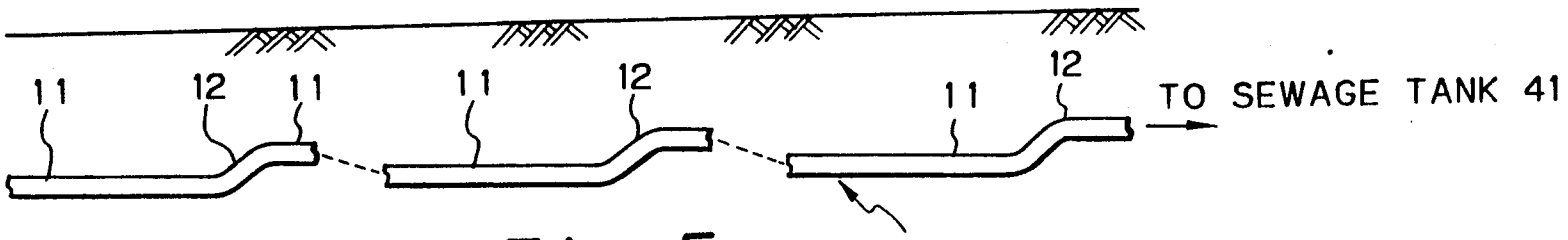
Fig. 4 PRIOR ART
FIG. 4 is a side sectional view representing a state where the vacuum sewer pipe to be laid in a plain topography is embedded in the ground in the conventional system.
Figure 5:
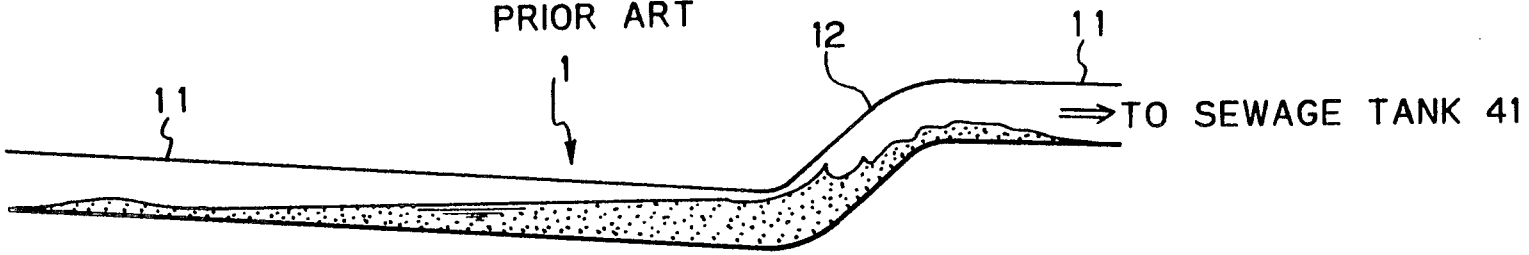
Fig. 5 PRIOR ART
FIG. 5 is an illustration representing a state where a sewage tides over the upward pitch portion of the vacuum sewer pipe in the conventional system.

The above downward pitch portion 11 and the upward pitch portion 12 are repeated, and the vacuum sewer pipe 1 is finally coupled to a sewage tank 41 (FIG. 3).

By this arrangement, a maximum pipe bottom depth B can be made as shallow as possible, and an excavating depth of a ditch at the time when the vacuum sewer pipe 1 is laid can be reduced, thereby reducing construction costs.

Next, a state where sewage flows in the vacuum sewer pipe 1 will be described.

A downward pitch portion 11 having 0.2 to 0.3% downward slope, which is positioned between a pair of short upward pitch portions 12, is comparatively long (50 to 100 m, for example).

The sewage flows downstream along the downward pitch portion 11 without an aid of air stream.

Figure 2:
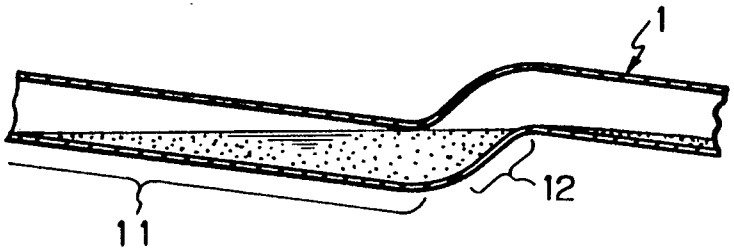
FIG. 2 is an illustration representing a state where a sewage flows in the vacuum sewer pipe 1 with the less quantity of air in accordance with the invention.

The sewage accumulates in the deepest portion, i.e., a shifting portion from the downward pitch portion 11 to the upward pitch portion 12 as shown in FIG. 2.

The sewage is then caught and dragged upwardly by the air stream flowing within the pipe at the upward pitch portion 12, and goes forward to the next downward pitch portion 11.

Figure 6:
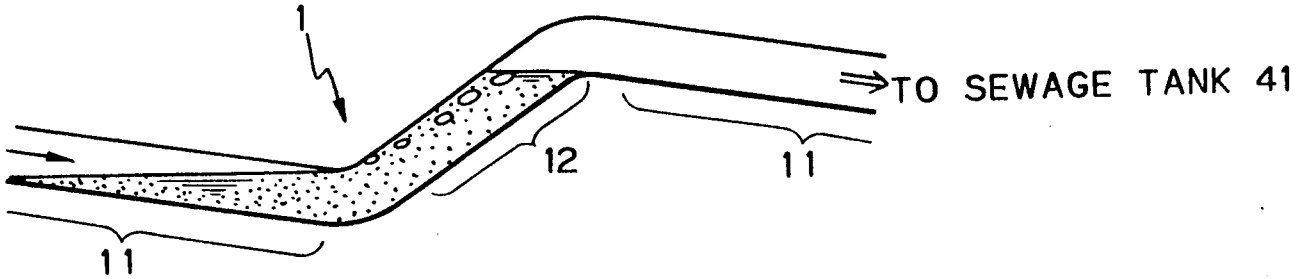
Fig. 6 PRIOR ART
FIG. 6 is an illustration representing a state of air locks produced in the prior art vacuum sewer pipe.

Here, in the case of a prior art vacuum sewer pipe, if the quantity of the air is low, or the air stream volume is small, an air lock will be produced at this portion as shown in FIG. 6.

However, in this invention, since the vacuum sewer pipe 1 is deepened by the downward pitch portion 11 only by the depth C which corresponds to 0.8 to 1.0 times of a bore D of the vacuum sewer pipe 1, air lock is not produced as will be explained in more detail hereinafter.

Here FIG. 2 represents a state where in this invention sewage flows in the vacuum sewer pipe 1 with a lower quantity of air.

As illustrated therein, even in the case that the sewage accumulates at the portion shifting from the downward pitch portion 11 to the upward pitch portion 12, the sewage will flow smoothly to the next downward pitch portion 11 in a state as coming nearly close to choking the pipe completely. Thus the vacuum sewer pipe 1 is free from an air lock inside.

Meanwhile, for the air stream to drag the sewage upward effectively at the upward pitch portion 12 and thus to form a slag flow, an air passage should be narrowed at a lower portion of the upward pitch portion 12 (or a portion shifting from the downward pitch portion 11 to the upward pitch portion 12), thereby effectively enhancing an air velocity. Then in this invention, when the depth C resulting from the downward slope of the downward pitch portion 11 is adjusted to 0.8 times of the bore D of the vacuum sewer pipe 1, a portion of the height corresponding to 0.2 times of the pipe bore functions as an air passage, and when it is adjusted to 1.0 time, the air passage becomes slightly chocked, and thus an air velocity can effectively be enhanced.

That is, according to this invention, an air lock will never be produced, and the air velocity necessary for the sewage to tide over the upward pitch portion 12 will be optimized.

As described in detail above, according to the laying structure for vacuum sewer pipe of a vacuum sewage collecting system of this invention, the following superior effects are realizable:

(1) Even in the case that the quantity of air flowing in the vacuum sewer pipe is low, an air lock will not be produced at the upward pitch portion, and a negative pressure generated in a vacuum pump house can be fed as far as the end of vacuum sewer pipe system.

(2) Since a laying depth of the vacuum sewer pipe can be made considerably shallow as compared with a prior art system, construction costs for pipe laying can be reduced.

What is claimed is:

1. A laying structure for a vacuum sewer pipe of a vacuum sewage collecting system for collecting sewage discharge from homes and facilities into a collecting tank through a vacuum sewer pipe kept negative in pressure internally, wherein said vacuum sewer pipe includes a portion laid in a plain topography which comprises a downward pitch portion sloped toward downstream, and a short upward pitch portion connected to the downstream end of said downward pitch portion to return a depth of said vacuum sewer pipe to an original level, said downward pitch portion and said upward pitch portion are alternated at least once, which is characterized in that:

said upward pitch portion starts from a spot deepened from said original laying level by a depth corresponding to 0.8 to 1.0 times of a bore of said vacuum sewer pipe.

2. A laying structure claimed in claim 1, wherein said upward pitch portion starts from a spot deepened from said original laying level by a depth corresponding to 0.8 times of said bore.

3. A laying structure claimed in claim 1, wherein said upward pitch portion starts from a spot deepened from said original laying level by a depth corresponding to 1.0 time of said bore.

4. A laying structure claimed in any one of claims 1 to 3, wherein said downward pitch portion has a slope of 0.2 to 0.3% with reference to a horizontal plane.

5. A laying structure claimed in claim 4, wherein said vacuum sewer pipe is connected through a vacuum valve to a cesspool located underground.

* * * * *